US011514833B2

(12) United States Patent
Seo et al.

(10) Patent No.: US 11,514,833 B2
(45) Date of Patent: Nov. 29, 2022

(54) TRANSPARENT DISPLAY DEVICE AND METHOD OF DRIVING THE SAME

(71) Applicant: Samsung Display Co., Ltd., Yongin-Si (KR)

(72) Inventors: Young-Jun Seo, Suwon-si (KR); Hyosun Kim, Seongnam-si (KR); Yongwoo Yi, Hwaseong-si (KR); Youra Kim, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/504,975

(22) Filed: Oct. 19, 2021

(65) Prior Publication Data

US 2022/0230570 A1 Jul. 21, 2022

(30) Foreign Application Priority Data

Jan. 15, 2021 (KR) ..... 10-2021-0006247

(51) Int. Cl.
*G09G 3/20* (2006.01)

(52) U.S. Cl.
CPC ..... *G09G 3/20* (2013.01); *G09G 2320/0673* (2013.01); *G09G 2360/14* (2013.01); *G09G 2360/16* (2013.01)

(58) Field of Classification Search
CPC ..... G09G 3/20; G09G 2320/0673; G09G 2360/14; G09G 2360/145; G09G 2360/16
See application file for complete search history.

(56) References Cited

U.S. PATENT DOCUMENTS 10,186,226 B2 * 1/2019 Seo ..... G09G 3/3685
2017/0061889 A1 * 3/2017 Seo ..... G09G 3/3275

FOREIGN PATENT DOCUMENTS

KR 102046220 B1 11/2019
KR 102079880 B1 2/2020

OTHER PUBLICATIONS

Kenneth W. Gish et al., "Human Factors Aspects of Using Head Up Displays in Automobiles: A Review of the Literature," Interim Report, U.S. Department of Transportation, National Highway Traffic Safety Administration, Aug. 1995.

* cited by examiner

*Primary Examiner* — Gene W Lee
(74) *Attorney, Agent, or Firm* — Cantor Colburn LLP

(57) ABSTRACT

A transparent display device includes a transparent display panel which displays an image, a scan driver which provides a scan signal to the transparent display panel, a data driver which converts image data into a data signal based on an application gamma curve, and which provides the data signal to the transparent display panel, a timing controller which controls the scan driver and the data driver, a luminance value compensator which calculates a perception luminance of the transparent display panel based on a luminance of incident light that is incident on the transparent display panel and a transmittance of the transparent display panel, and a gamma curve adjuster which adjusts the application gamma curve based on a reference gamma value of a reference gamma curve and the perception luminance of the transparent display panel.

18 Claims, 6 Drawing Sheets

TRANSPARENT DISPLAY DEVICE AND METHOD OF DRIVING THE SAME

This application claims priority to Korean Patent Application No. 10-2021-0006247 filed on Jan. 15, 2021, and all the benefits accruing therefrom under 35 U.S.C. § 119, the content of which in its entirety is herein incorporated by reference.

BACKGROUND

1. Field

Embodiments of the present inventive concept relate to a display device. More particularly, embodiments of the present inventive concept relate to a transparent display device and a method of driving the same.

2. Description of the Related Art

Interest in a transparent display device (e.g., automobile windows, show windows, building windows, etc.) that allows a user to view an object located on a rear side with visual information displayed on the display device is increasing. In general, since external light directly affects an image in the transparent display device, a tone change caused by the external light, a decrease in image clarity, or the like may occur in the image. Accordingly, the image displayed by the transparent display device may not be clearly perceived by the user in an environment with strong external light. In order to solve such problems, according to a conventional transparent display device, a gamma curve corresponding to a tone curve is set in consideration of a general environment (e.g., a gamma curve of 2.2) such that the gamma curve is adjusted according to content (e.g., moving images, still images, etc.), or a panel luminance is adjusted according to ambient brightness. However, the conventional transparent display device does not use a luminance of incident light that is incident on a transparent display panel and a transmittance of the transparent display panel, which is a hardware characteristic of the transparent display panel, so that there are limitations in terms of effects.

SUMMARY

Embodiments of the present inventive concept provide a transparent display device capable of calculating a perception luminance based on a luminance of incident light that is incident on a transparent display panel and a transmittance of the transparent display panel, and adjusting an application gamma curve based on a reference gamma value of a reference gamma curve and the perception luminance of the transparent display panel.

Embodiments of the present inventive concept also provide a method of driving a transparent display device, capable of calculating a perception luminance based on a luminance of incident light that is incident on a transparent display panel and a transmittance of the transparent display panel, and adjusting an application gamma curve based on a reference gamma value of a reference gamma curve and the perception luminance of the transparent display panel.

However, Embodiments of the present inventive concept are not limited to the above-described embodiments, and may be variously extended without departing from the idea and scope of the present inventive concept.

In an embodiment of a transparent display device according to the present inventive concept, the transparent display device includes a transparent display panel which displays an image, a scan driver which provides a scan signal to the transparent display panel, a data driver which converts image data into a data signal based on an application gamma curve, and which provides the data signal to the transparent display panel, a timing controller which controls the scan driver and the data driver, a luminance value compensator which calculates a perception luminance of the transparent display panel based on a luminance of incident light that is incident on the transparent display panel and a transmittance of the transparent display panel, and a gamma curve adjuster which adjusts the application gamma curve based on a reference gamma value of a reference gamma curve and the perception luminance of the transparent display panel.

In an embodiment, the luminance value compensator may be configured to calculate the perception luminance of the transparent display panel based on Formula 1 representing a relation between the perception luminance of the transparent display panel, a stimulation luminance of the transparent display panel and a background luminance of the transparent display panel:

$$Lper=\{\alpha\cdot Lsti+\beta\}\cdot\{\gamma\cdot\log(Lsti/Lbg)+1\} \quad \text{[Formula 1]}$$

wherein Lper is the perception luminance, Lsti is the stimulation luminance, Lbg is the background luminance, $\alpha$ is a first constant, $\beta$ is a second constant, and $\gamma$ is a third constant.

In an embodiment, the stimulation luminance of the transparent display panel may be calculated based on Formula 2:

$$Lsti=Lim+\{Lin\cdot T\} \quad \text{[Formula 2]}$$

wherein Lim is an image luminance, Lin is the luminance of the incident light, and T is the transmittance of the transparent display panel.

In an embodiment, the background luminance of the transparent display panel may be calculated based on Formula 3:

$$Lbg=Lnim+\{Lin\cdot T\} \quad \text{[Formula 3]}$$

wherein Lnim is a non-image luminance, Lin is the luminance of the incident light, and T is the transmittance of the transparent display panel.

In an embodiment, the transparent display device may further include an incident light sensor which measures the luminance of the incident light to provide incident light information representing the luminance of the incident light to the luminance value compensator.

In an embodiment, the luminance value compensator may be configured to receive transmittance information representing the transmittance of the transparent display panel from the transparent display panel.

In an embodiment, the gamma curve adjuster may be configured to receive perception luminance information representing the perception luminance of the transparent display panel from the luminance value compensator.

In an embodiment, the gamma curve adjuster may include a gamma curve storing block which stores the reference gamma curve, a gamma value calculating block which calculates an application gamma value based on the reference gamma value of the reference gamma curve and the perception luminance of the transparent display panel and a gamma curve generating block which generates the application gamma curve having the application gamma value.

In an embodiment, the reference gamma value of the reference gamma curve may be 2.2.

In an embodiment, when the transmittance is 35 percentages (%), the luminance value compensator may be configured to calculate the perception luminance of the transparent display panel based on Formula 4:

$$Lper=\{2.2\cdot Lsti+74.0\}\cdot\{1.5\cdot\log(Lst/Lbg)+1\}. \quad \text{[Formula 4]}$$

In an embodiment, when the transmittance is 70%, the luminance value compensator may be configured to calculate the perception luminance of the transparent display panel based on Formula 5:

$$Lper=\{1.4\cdot Lsti+88.3\}\cdot\{1.0\cdot\log(Lsti/Lbg)+1\}. \quad \text{[Formula 5]}$$

In an embodiment of a method of driving a transparent display device according to the present inventive concept, the method includes: calculating, by a first processor, a perception luminance of a transparent display panel based on a luminance of incident light that is incident on the transparent display panel and a transmittance of the transparent display panel; calculating, by a second processor, an application gamma value based on a reference gamma value of a reference gamma curve and the perception luminance of the transparent display panel; generating an application gamma curve having the application gamma value; and converting image data into a data signal, which is to be applied to the transparent display panel, based on the application gamma curve.

In an embodiment, the perception luminance of the transparent display panel may be calculated based on Formula 6 representing a relation between the perception luminance of the transparent display panel, a stimulation luminance of the transparent display panel and a background luminance of the transparent display panel:

$$Lper=\{\alpha\cdot Lsti+\beta\}\cdot\{\gamma\cdot\log(Lsti/Lbg)+1\} \quad \text{[Formula 6]}$$

wherein Lper is the perception luminance, Lsti is the stimulation luminance, Lbg is the background luminance, $\alpha$ is a first constant, $\beta$ is a second constant, and $\gamma$ is a third constant.

In an embodiment, the stimulation luminance of the transparent display panel may be calculated based on Formula 7:

$$Lsti=Lim+\{Lin\cdot T\} \quad \text{[Formula 7]}$$

wherein Lim is an image luminance, Lin is the luminance of the incident light, and T is the transmittance of the transparent display panel.

In an embodiment, the background luminance of the transparent display panel may be calculated based on Formula 8:

$$Lbg=Lnim+\{Lin\cdot T\} \quad \text{[Formula 8]}$$

wherein Lnim is a non-image luminance, Lin is the luminance of the incident light, and T is the transmittance of the transparent display panel.

In an embodiment, the method may further include: measuring, by a sensor, the luminance of the incident light to generate incident light information representing the luminance of the incident light.

In an embodiment, the method may further include: receiving, by the first processor, transmittance information representing the transmittance of the transparent display panel from the transparent display panel.

In an embodiment, the reference gamma value of the reference gamma curve may be 2.2.

In an embodiment, when the transmittance is 35%, the perception luminance of the transparent display panel may be calculated based on Formula 9:

$$Lper=\{2.2\cdot Lsti+74.0\}\cdot\{1.5\cdot\log(Lsti/Lbg)+1\}. \quad \text{[Formula 9]}$$

In an embodiment, when the transmittance is 70%, the perception luminance of the transparent display panel may be calculated based on Formula 10:

$$Lper=\{1.4\cdot Lsti+88.3\}\cdot\{1.0\cdot\log(Lsti/Lbg)+1\}. \quad \text{[Formula 10]}$$

According to embodiments of the present inventive concept, the transparent display device may calculate the perception luminance based on the luminance of the incident light that is incident on the transparent display panel and the transmittance of the transparent display panel, and may adjust the application gamma curve based on the reference gamma value of the reference gamma curve and the perception luminance of the transparent display panel. As a result, the transparent display device may effectively reduce a tone change caused by external light, and effectively reduce a decrease in image clarity.

According to embodiments of the present inventive concept, the method of driving the transparent display device may operate the transparent display device to display a high-quality image in various external light environments.

DETAILED DESCRIPTION

Figure 1:
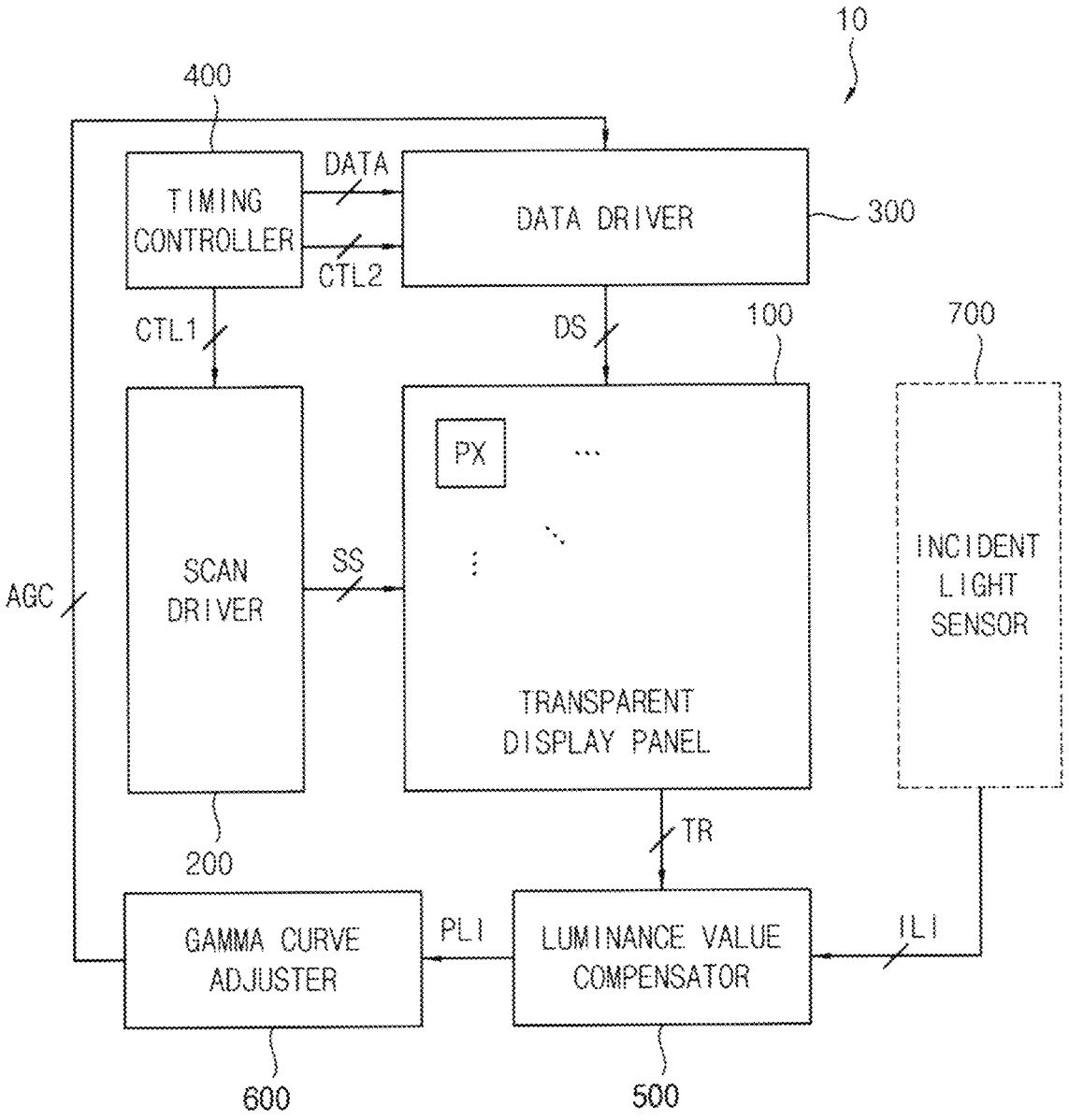
FIG. 1 is a block diagram illustrating a transparent display device according to embodiments of the present inventive concept.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, embodiments of the present inventive concept will be described in more detail with reference to the accompanying drawings. The same reference numerals will be used for the same elements in the drawings, and redundant descriptions of the same elements will be omitted.

FIG. 1 is a block diagram illustrating a transparent display device 10 according to embodiments of the present inventive concept.

Referring to FIG. 1, a transparent display device 10 may include a transparent display panel 100, a scan driver 200, a data driver 300, a timing controller 400, a luminance value compensator 500, and a gamma curve adjuster 600. In some embodiments, the transparent display device 10 may further include an incident light sensor 700. Although the transparent display device 10 may be an organic light emitting diode display device or a liquid crystal display device, the transparent display device 10 according to the invention is not limited thereto.

The transparent display panel 100 may include a plurality of pixels PX, and may display an image including a text, a picture, or the like. In other words, since the transparent display panel 100 is transparent, the transparent display panel 100 may allow a user to see an object located on a rear side of the transparent display panel 100 in addition to the displayed image. The transparent display panel 100 may be an Augmented Reality ("AR") glass, but the transparent display panel 100 according to the invention is not limited thereto. The transparent display panel 100 may be connected to the scan driver 200 through scan lines. The transparent display panel 100 may be connected to the data driver 300 through data lines. The scan driver 200 may provide a scan signal SS to the transparent display panel 100 through the scan lines. The data driver 300 may convert image data DATA into a data signal DS based on an application gamma curve AGC, and provide the data signal DS to the transparent display panel 100 through the data lines. The timing controller 400 may generate control signals CTL1 and CTL2 to control the scan driver 200 and the data driver 300, respectively. The timing controller 400 may receive the image data DATA from an outside, perform a predetermined processing (e.g., compensation for degradation, etc.) on the image data DATA, and provide the processed image data DATA to the data driver 300. In general, since external light directly affects the image in the transparent display device 10, a tone change caused by the external light, a decrease in image clarity, or the like may occur in the image. Accordingly, the image displayed by the transparent display device 10 may not be clearly perceived by the user in an environment with strong external light. In order to solve such problems, the luminance value compensator 500 may calculate a perception luminance Lper (See Formulas below) of the transparent display panel 100 based on a luminance of incident light that is incident on the transparent display panel 100 and a transmittance of the transparent display panel 100. In addition, the gamma curve adjuster 600 may adjust the application gamma curve AGC based on a reference gamma value RGV of a reference gamma curve RGC and the perception luminance Lper of the transparent display panel 100. In other words, the transparent display device 10 may improve image quality by using the luminance of the incident light Lin (See Formula 2 below) that is incident on the transparent display panel 100 and the transmittance T (See Formula 2 below) of the transparent display panel 100, which is a hardware characteristic of the transparent display panel 100.

Figure 2:
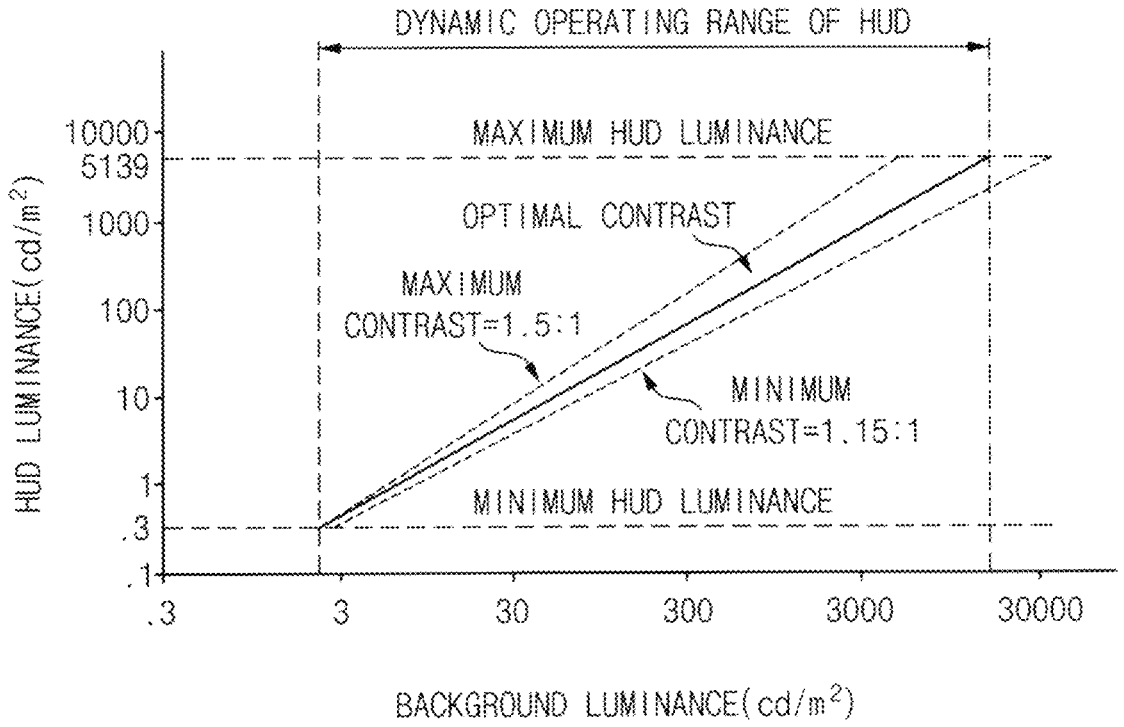
FIG. 2 is a graph for describing an operation of a luminance value compensator included in the transparent display device of FIG. 1.

FIG. 2 is a graph for describing an operation of a luminance value compensator included in the transparent display device 10 of FIG. 1.

Referring to FIGS. 1 and 2, the luminance value compensator 500 may calculate the perception luminance Lper of the transparent display panel 100 based on the luminance of the incident light Lin that is incident on the transparent display panel 100 and the transmittance T of the transparent display panel 100.

As illustrated in FIG. 2, sharpness of the transparent display panel 100 may be determined according to a contrast ratio. FIG. 2 shows an example of human factors aspects when the transparent display panel 100 is a head-up display (HUD) in automobiles. For example, HUD LUMINANCE denotes a luminance of the head-up display in automobiles, and BACKGROUND LUMINANCE denotes a background luminance of the head-up display in automobiles. The contrast ratio may be determined according to a stimulation luminance of the transparent display panel 100, a background luminance of the transparent display panel 100, and the transmittance of the transparent display panel 100. With regard to the sharpness of the transparent display panel 100 perceived by the user, highest visibility may be ensured when the contrast ratio is 1.15 or more and 1.5 or less. For example, when the contrast ratio is 1.15 or less, the sharpness of the transparent display panel 100 may be relatively decreased, so that the visibility of the user may be decreased. As another example, when the contrast ratio is 1.5 or more, the sharpness of the transparent display panel 100 may be relatively increased, so that a surrounding environment may not be visually recognized. Therefore, in order to calculate an appropriate perception luminance Lper, maintaining the contrast ratio of 1.15 or more and 1.5 or less may be desirable. According to the present inventive concept, since the transparent display device 10 adjusts the application gamma curve by using the perception luminance Lper calculated by reflecting the contrast ratio, an image that may be clearly perceived even in an environment with strong external light may be provided to the user.

For example, the luminance value compensator 500 may calculate the perception luminance Lper of the transparent display panel 100 based on Formula 1 representing a relation between the perception luminance Lper of the transparent display panel 100, and the stimulation luminance of the transparent display panel 100 and the background luminance of the transparent display panel 100 as follows.

$$Lper=\{\alpha\cdot Lsti+\beta\}\cdot\{\gamma\cdot\log(Lsti/Lbg)+1\} \quad \text{[Formula 1]}$$

In this case, Lper is the perception luminance, Lsti is the stimulation luminance, Lbg is the background luminance, $\alpha$ is a first constant, $\beta$ is a second constant, and $\gamma$ is a third constant. The stimulation luminance may be a value obtained by adding a luminance of an image portion displayed on the transparent display panel 100 and a luminance increased by the external light. The background luminance Lbg may be a value obtained by adding a luminance of a non-image portion displayed on the transparent display panel 100 and the luminance increased by the external light. In other words, when the luminances of the image portion and the non-image portion displayed on the transparent display panel 100 are increased by the external light, the perception luminance Lper may represent a luminance of the transparent display panel 100 that may be perceived by the user.

In one embodiment, the luminance value compensator 500 may calculate the perception luminance Lper by using a look-up table ("LUT") in which Formula 1 is stored. In this case, the look-up table in which Formula 1 is stored may store the first constant $\alpha$, the second constant $\beta$, and the third constant $\gamma$, which depend on the transmittance of the transparent display panel 100.

The luminance value compensator 500 may receive incident light information ILI representing the luminance of the incident light Lin that is incident on the transparent display panel 100 from the incident light sensor 700, and may receive transmittance information TR representing the transmittance of the transparent display panel 100 from the transparent display panel 100. The luminance value compensator 500 may calculate the stimulation luminance and the background luminance of the transparent display panel 100 based on the luminance of the incident light Lin that is incident on the transparent display panel 100 and the transmittance of the transparent display panel 100. In detail, the transparent display device 10 may further include the incident light sensor 700 configured to provide the incident light information ILI representing the luminance of the incident light Lin to the luminance value compensator 500. In other words, the transparent display device 10 may include a built-in luminance sensor for measuring the luminance of the incident light Lin that is incident on the transparent display panel 100. The incident light sensor 700 may measure the luminance of the incident light Lin that is incident on the transparent display device 10 by sensing an external illuminance. The incident light sensor 700 may measure the luminance of the incident light Lin to transmit the incident light information ILI to the luminance value compensator 500. In addition, the luminance value compensator 500 may receive the transmittance information TR representing the transmittance of the transparent display panel 100 from the transparent display panel 100. For example, the transmittance of the transparent display panel 100 may correspond to a characteristic value of the transparent display panel 100. As another example, the transmittance of the transparent display panel 100 may be settable.

In one embodiment, the stimulation luminance may be the value obtained by adding the luminance of the image portion displayed on the transparent display panel 100 and the luminance increased by the external light. The stimulation luminance of the transparent display panel 100 may be calculated based on Formula 2 as follows.

$$Lsti = Lim + \{Lin \cdot T\} \quad \text{[Formula 2]}$$

In this case, Lsti is the stimulation luminance, Lim is an image luminance, Lin is the luminance of the incident light, and T is the transmittance. The image luminance Lim may represent the luminance of the image portion displayed on the transparent display panel 100. In other words, the image luminance Lim may represent a luminance of a target image that is to be provided to the user on the transparent display panel 100. The luminance value compensator 500 may calculate the stimulation luminance by using a look-up table in which Formula 2 is stored.

In one embodiment, the background luminance may be the value obtained by adding the luminance of the non-image portion displayed on the transparent display panel 100 and the luminance increased by the external light. The background luminance of the transparent display panel 100 may be calculated based on Formula 3 as follows.

$$Lbg = Lnim + \{Lin \cdot T\} \quad \text{[Formula 3]}$$

In this case, Lbg is the background luminance, Lnim is a non-image luminance, Lin is the luminance of the incident light, and T is the transmittance. The non-image luminance may represent the luminance of the non-image portion displayed on the transparent display panel 100. In other words, the non-image luminance may represent a luminance of a portion except for the target image that is to be provided to the user on the transparent display panel 100. The luminance value compensator 500 may calculate the background luminance by using a look-up table in which Formula 3 is stored.

The luminance value compensator 500 may calculate the perception luminance Lper of the transparent display panel 100 based on the luminance of the incident light Lin that is incident on the transparent display panel 100 and the transmittance of the transparent display panel 100, and may transmit the perception luminance information PLI to the gamma curve adjuster 600.

Figure 3:
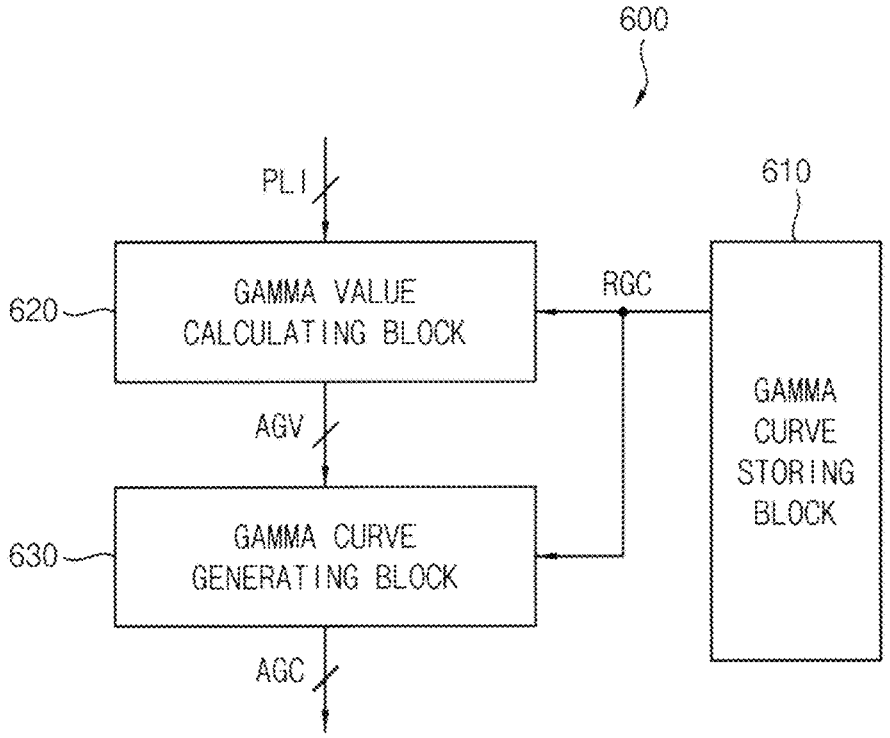
FIG. 3 is a block diagram illustrating a gamma curve adjuster included in the transparent display device of FIG. 1.
Figure 4:
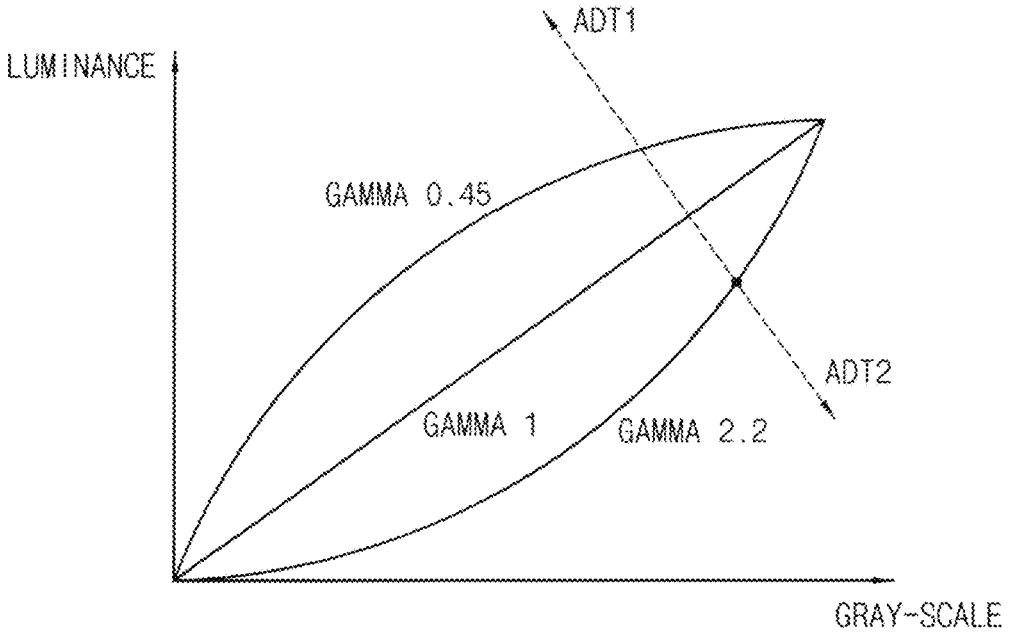
FIG. 4 is a diagram illustrating an application gamma curve adjusted by the gamma curve adjuster of FIG. 3.

FIG. 3 is a block diagram illustrating a gamma curve adjuster included in the transparent display device 10 of FIG. 1, and FIG. 4 is a diagram illustrating an application gamma curve adjusted by the gamma curve adjuster 600 of FIG. 3.

Referring to FIGS. 1 to 4, the gamma curve adjuster 600 may store the reference gamma value RGV of the reference gamma curve RGC, and may receive the perception luminance information PLI representing the perception luminance Lper of the transparent display panel 100. The gamma curve adjuster 600 may adjust the application gamma curve based on the reference gamma value of the reference gamma curve and the perception luminance Lper of the transparent display panel 100.

As illustrated in FIG. 3, the gamma curve adjuster 600 may include a gamma curve storing block 610, a gamma value calculating block 620, and a gamma curve generating block 630. The gamma curve storing block 610 may store the reference gamma curve RGC, and provide the reference gamma curve RGC to the gamma value calculating block 620 and the gamma curve generating block 630.

In one embodiment, the gamma value calculating block 620 may receive the reference gamma curve RGC and the perception luminance information PLI representing the perception luminance Lper of the transparent display panel 100, and may calculate an application gamma value AGV based on the reference gamma value RGV of the reference gamma curve RGC and the perception luminance Lper of the transparent display panel 100. The gamma curve generating block 630 may receive the application gamma value AGV from the gamma value calculating block 620, and generate the application gamma curve AGC having the application gamma value AGV. In some embodiments, the gamma curve adjuster 600 may be implemented as a simple calculation circuit or a look-up table (LUT). In this case, the reference gamma value RGV of the reference gamma curve RGC may be 22 in consideration of a darkroom environment. For example, as illustrated in FIG. 4, a gamma curve of 2.2 (GAMMA 2.2) may be set as the reference gamma curve RGC. The gamma value calculating block 620 may calculate the application gamma value AGV of the application gamma curve AGC that maintains the reference gamma value RGV of the reference gamma curve RGC at 2.2 based on the perception luminance Lper of the transparent display panel 100.

As described above, according to the present inventive concept, the transparent display device 10 may calculate the perception luminance Lper based on the luminance of the incident light Lin that is incident on the transparent display panel 100 and the transmittance of the transparent display panel 100, and may adjust the application gamma curve based on the reference gamma value of the reference gamma curve and the perception luminance Lper of the transparent display panel 100, so that the transparent display device 10. Accordingly, the transparent display device 10 may effectively reduce the tone change caused by external light, and effectively reduce the decrease in the image clarity. As a result, the transparent display device 10 may display a high-quality image in various external light environments. Although the transparent display device 10 has been described above as adjusting the gamma curve, in the present inventive concept, the gamma curve should be interpreted in a broad sense encompassing the tone curve without being interpreted in a narrow sense.

Figure 5:
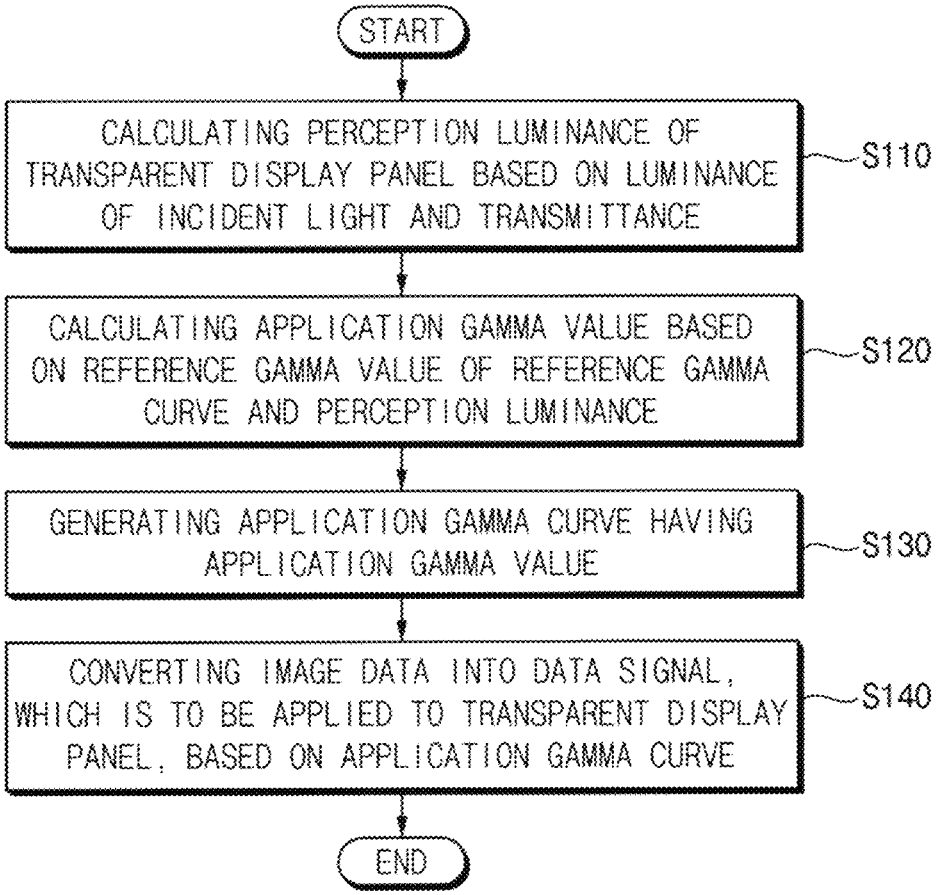
FIG. 5 is a flowchart illustrating a method of driving a transparent display device according to embodiments of the present inventive concept.

FIG. 5 is a flowchart illustrating a method of driving a transparent display device 10 according to embodiments of the present inventive concept.

Referring to FIGS. 1 and 5, the transparent display device 10 according to the present inventive concept may calculate a perception luminance Lper of a transparent display panel 100 based on a luminance of incident light and a transmittance (operation S110), calculate an application gamma value based on a reference gamma value of a reference gamma curve and the perception luminance Lper (operation S120), generate an application gamma curve having the application gamma value (operation S130), and convert image data into a data signal, which is to be applied to the transparent display panel 100, based on the application gamma curve (operation S140).

In one embodiment, the transparent display device 10 may calculate the perception luminance Lper of the transparent display panel 100 based on the luminance of the incident light Lin and the transmittance (operation S110). A luminance value compensator 500 may calculate the perception luminance Lper of the transparent display panel 100 based on the luminance of the incident light that is incident on the transparent display panel 100 and the transmittance of the transparent display panel 100.

The transparent display device 10 may further include an incident light sensor 700 configured to provide incident light information ILI representing the luminance of the incident light Lin to the luminance value compensator 500. In other words, the transparent display device 10 may include a built-in luminance sensor for measuring the luminance of the incident light that is incident on the transparent display panel 100. The incident light sensor 700 may measure the luminance of the incident light Lin that is incident on the transparent display device 10 by sensing an external illuminance. The incident light sensor 700 may measure the luminance of the incident light to transmit the incident light information ILI to the luminance value compensator 500. The luminance value compensator 500 may receive the incident light information ILI representing the luminance of the incident light Lin that is incident on the transparent display panel 100 from the incident light sensor 700. In addition, the luminance value compensator 500 may receive transmittance information TR representing the transmittance of the transparent display panel 100 from the transparent display panel 100. In this case, the transmittance of the transparent display panel 100 may correspond to a characteristic value of the transparent display panel 100. In some embodiments, the transmittance of the transparent display panel 100 may be settable.

The luminance value compensator 500 may calculate a stimulation luminance and a background luminance of the transparent display panel 100 based on the luminance of the incident light Lin that is incident on the transparent display panel 100 and the transmittance of the transparent display panel 100. The stimulation luminance may be a value obtained by adding a luminance of an image portion displayed on the transparent display panel 100 and a luminance increased by external light. The background luminance may be a value obtained by adding a luminance of a non-image portion displayed on the transparent display panel 100 and the luminance increased by the external light.

The stimulation luminance of the transparent display panel 100 may be calculated based on Formula 7 as follows.

$$Lsti=Lim+\{Lin\cdot T\} \quad \text{[Formula 7]}$$

In this case, Lsti is the stimulation luminance, Lim is an image luminance, Lin is the luminance of the incident light, and T is the transmittance. The image luminance may represent the luminance of the image portion displayed on the transparent display panel 100. In other words, the image luminance may represent a luminance of a target image that is to be provided to the user on the transparent display panel 100. The luminance value compensator 500 may calculate the stimulation luminance by using a look-up table in which Formula 7 is stored.

The background luminance of the transparent display panel 100 may be calculated based on Formula 8 as follows.

$$Lbg=Lnim+\{Lin\cdot T\} \quad \text{[Formula 8]}$$

In this case, Lbg is the background luminance, Lnim is a non-image luminance, Lin is the luminance of the incident light, and T is the transmittance. The non-image luminance may represent the luminance of the non-image portion displayed on the transparent display panel 100. In other words, the non-image luminance may represent a luminance of a portion except for the target image that is to be provided to the user on the transparent display panel 100. The luminance value compensator 500 may calculate the background luminance by using a look-up table in which Formula 8 is stored.

The luminance value compensator 500 may calculate the perception luminance Lper of the transparent display panel 100 based on Formula 6 representing a relation between the perception luminance Lper of the transparent display panel 100, and the stimulation luminance of the transparent display panel 100 and the background luminance of the transparent display panel 100 as follows.

$$Lper=\{\alpha\cdot Lsti+\beta\}\cdot\{\gamma\cdot\log(Lsti/Lbg)+1\} \quad \text{[Formula 6]}$$

In this case, Lper is the perception luminance, Lsti is the stimulation luminance, Lbg is the background luminance, $\alpha$ is a first constant, $\beta$ is a second constant, and $\gamma$ is a third constant. The stimulation luminance may be the value obtained by adding the luminance of the image portion displayed on the transparent display panel 100 and the luminance increased by the external light. The background luminance may be the value obtained by adding the luminance of the non-image portion displayed on the transparent display panel 100 and the luminance increased by the external light. In other words, when the luminances of the image portion and the non-image portion displayed on the transparent display panel 100 are increased by the external light, the perception luminance Lper may represent a luminance of the transparent display panel 100 that may be perceived by the user. The luminance value compensator 500 may calculate the perception luminance Lper by using a look-up table in which Formula 6 is stored. In this case, the look-up table in which Formula 6 is stored may store the first constant $\alpha$, the second constant $\beta$, and the third constant $\gamma$, which depend on the transmittance of the transparent display panel 100. For example, when the transmittance is 35 percentages (%), the luminance value compensator 500 may calculate the perception luminance Lper of the transparent display panel 100 based on Formula 9 as follows.

$$Lper=\{2.2\cdot Lsti+74.0\}\cdot\{1.5\cdot\log(Lsti/Lbg)+1\} \quad \text{[Formula 9]}$$

As another example, when the transmittance is 70%, the luminance value compensator 500 may calculate the perception luminance Lper of the transparent display panel 100 based on Formula 10 as follows.

$$Lper=\{1.4\cdot Lsti+88.3\}\cdot\{1.0\cdot\log(Lsti/Lbg)+1\} \quad \text{[Formula 10]}$$

Therefore, the luminance value compensator 500 may calculate the perception luminance Lper that may be actually perceived by the user by reflecting the luminance of the incident light according to an illuminance of the external light and the transmittance of the transparent display panel 100, so that the application gamma curve that optimizes the visibility of the user for the transparent display panel 100 may be determined. The luminance value compensator 500 may calculate the perception luminance Lper of the transparent display panel 100 based on the luminance of the incident light that is incident on the transparent display panel 100 and the transmittance of the transparent display panel 100, and transmit perception luminance information PLI to a gamma curve adjuster 600.

In one embodiment, the transparent display device 10 may calculate the application gamma value based on the reference gamma value of the reference gamma curve and the perception luminance Lper (operation S120), and generate the application gamma curve having the application gamma value (operation S130). In detail, the gamma curve adjuster 600 may store the reference gamma value RGV of the reference gamma curve RGC, and may receive the perception luminance information PLI representing the perception luminance Lper of the transparent display panel 100. The gamma curve adjuster 600 may adjust the application gamma curve based on the reference gamma value of the reference gamma curve and the perception luminance Lper of the transparent display panel 100. For example, the gamma curve adjuster 600 may include a gamma curve storing block 610, a gamma value calculating block 620, and a gamma curve generating block 630. The gamma value calculating block 620 may receive the reference gamma curve RGC and the perception luminance information PLI representing the perception luminance Lper of the transparent display panel 100, and may calculate the application gamma value AGV based on the reference gamma value RGV of the reference gamma curve RGC and the perception luminance Lper of the transparent display panel 100. The gamma curve generating block 630 may receive the application gamma value AGV from the gamma value calculating block 620, and generate the application gamma curve AGC having the application gamma value AGV. In some embodiments, the gamma curve adjuster 600 may be implemented as a simple calculation circuit or a look-up table (LUT). In this case, the reference gamma value RGV of the reference gamma curve RGC may be 2.2 in consideration of a dark-room environment. For example, as illustrated in FIG. 4, a gamma curve of 2.2 (GAMMA 2.2) may be set as the reference gamma curve RGC. The gamma value calculating block 620 may calculate the application gamma value AGV of the application gamma curve AGC that maintains the reference gamma value RGV of the reference gamma curve RGC at 2.2 based on the perception luminance Lper of the transparent display panel 100.

In one embodiment, the transparent display device 10 according to the present inventive concept may convert the image data into the data signal, which is to be applied to the transparent display panel 100, based on the application gamma curve (operation S140). In detail, the transparent display panel 100 may be connected to a data driver 300 through data lines. The data driver 300 may convert the image data DATA into the data signal DS based on the application gamma curve AGC, and provide the data signal DS to the transparent display panel 100 through the data lines.

As described above, according to the present inventive concept, the transparent display device 10 may calculate the perception luminance Lper based on the luminance of the incident light that is incident on the transparent display panel 100 and the transmittance of the transparent display panel 100, and may adjust the application gamma curve based on the reference gamma value of the reference gamma curve and the perception luminance Lper of the transparent display panel 100. Accordingly, the transparent display device 10 may effectively reduce the tone change caused by external light, and effectively reduce the decrease in the image clarity. As a result, the transparent display device 10 may display a high-quality image in various external light environments.

Figure 6:
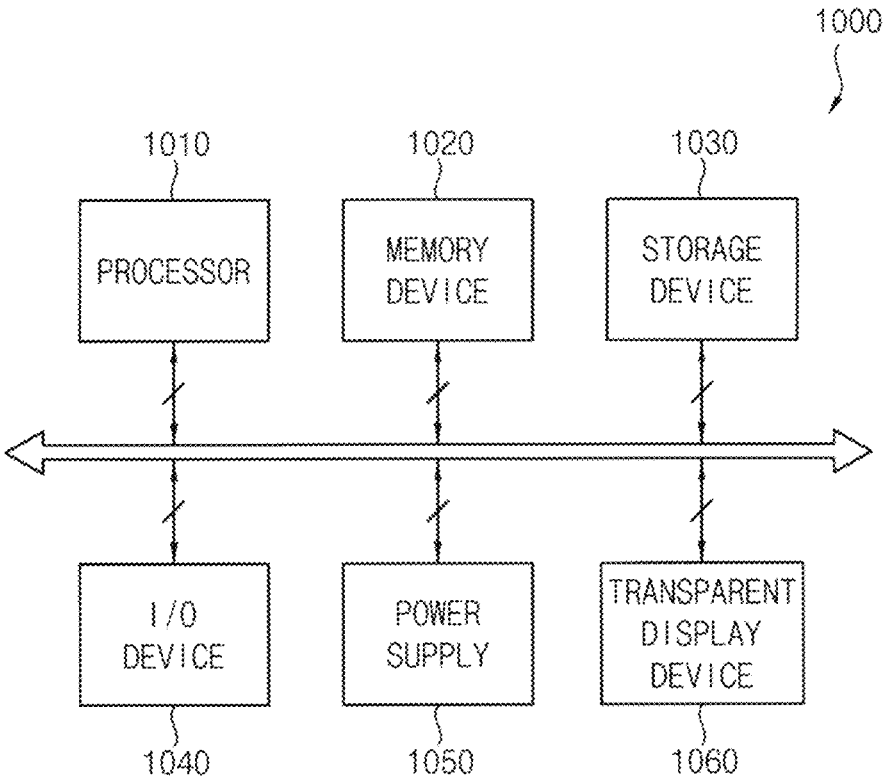
FIG. 6 is a block diagram illustrating an electronic device according to embodiments of the present inventive concept.
Figure 7:
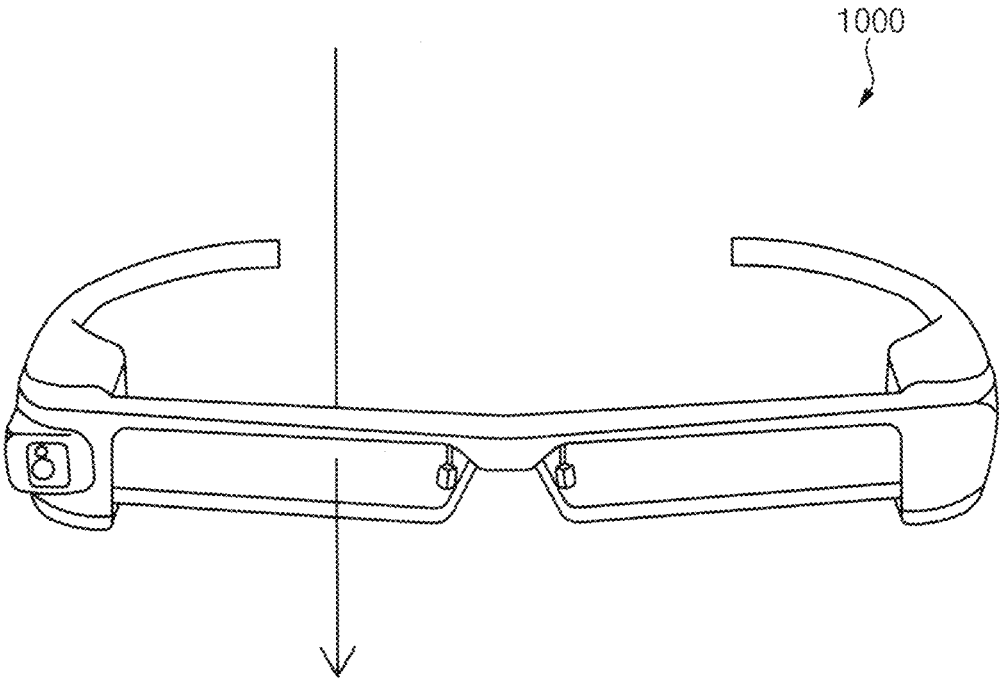
FIG. 7 is a diagram illustrating one example in which the electronic device of FIG. 6 is implemented as an AR glass.

FIG. 6 is a block diagram illustrating an electronic device according to embodiments of the present inventive concept. FIG. 7 is a diagram illustrating one example in which the electronic device of FIG. 6 is implemented as an AR glass.

Referring to FIGS. 6 and 7, the electronic device 1000 may include a processor 1010, a memory device 1020, a storage device 1030, an input/output ("I/O") device 1040, a power supply 1050, and a transparent display device 1060. In addition, the electronic device 1000 may further include a plurality of ports for communicating with a video card, a sound card, a memory card, a universal serial bus ("USB") device, other electronic devices, or the like. In an embodiment, as illustrated in FIG. 7, the electronic device 1000 may be implemented as an AR glass. However, the electronic device 1000 according to the invention is not limited thereto. For example, the electronic device 1000 may be implemented as a cellular phone, a video phone, a smart pad, a smart watch, a tablet PC, a car navigation system, a computer monitor, a laptop, a head mounted display ("HMD") device, or the like.

The processor 1010 may perform various computing functions. The processor 1010 may be a micro processor, a central processing unit ("CPU"), an application processor ("AP"), or the like. The processor 1010 may be coupled to other components via an address bus, a control bus, a data bus, or the like. Further, the processor 1010 may be coupled to an extended bus such as a peripheral component interconnection ("PCI") bus. The memory device 1020 may store data for operations of the electronic device 1000. For example, the memory device 1020 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, or the like and/or at least one volatile memory device such as a dynamic random access memory ("DRAM") device, a static random access memory ("SRAM") device, a mobile DRAM device, or the like. The storage device 1030 may include a solid state drive ("SSD") device, a hard disk drive ("HDD") device, a CD-ROM device, or the like. The I/O device 1040 may include an input device such as a keyboard, a keypad, a mouse device, a touch-pad, a touch-screen, or the like, and an output device such as a printer, a speaker, or the like. In some embodiments, the I/O device 1040 may include the transparent display device 1060. The power supply 1050 may provide power for operations of the electronic device 1000.

The transparent display device 1060 may display an image corresponding to visual information of the electronic device 1000. The transparent display device 1060 may include a transparent display panel configured to display an image, a scan driver configured to provide a scan signal to the transparent display panel, a data driver configured to convert image data into a data signal based on an application gamma curve, and configured to provide the data signal to the transparent display panel, a timing controller configured to control the scan driver and the data driver, a luminance value compensator configured to calculate a perception luminance of the transparent display panel based on a luminance of incident light that is incident on the transparent display panel and a transmittance of the transparent display panel, and a gamma curve adjuster configured to adjust the application gamma curve based on a reference gamma value of a reference gamma curve and the perception luminance of the transparent display panel. Accordingly, the transparent display device 1060 may effectively reduce the tone change caused by external light, and effectively reduce the decrease in the image clarity. As a result, the transparent display device 1060 may display a high-quality image in various external light environments. However, since these are described above, duplicated description related thereto will not be repeated.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A transparent display device comprising:

a transparent display panel which displays an image;

a scan driver which provides a scan signal to the transparent display panel;

a data driver which converts image data into a data signal based on an application gamma curve, and which provides the data signal to the transparent display panel;

a timing controller which controls the scan driver and the data driver;

a luminance value compensator which calculates a perception luminance of the transparent display panel based on a luminance of incident light that is incident on the transparent display panel and a transmittance of the transparent display panel; and a gamma curve adjuster which adjusts the application gamma curve based on a reference gamma value of a reference gamma curve and the perception luminance of the transparent display panel, wherein the luminance value compensator is configured to calculate the perception luminance of the transparent display panel based on Formula 1 representing a relation between the perception luminance of the transparent display panel, a stimulation luminance of the transparent display panel and a background luminance of the transparent display panel:

$$Lper=\{\alpha\cdot Lsti+\beta\}\cdot\{\gamma\cdot\log(Lsti/Lbg)+1\} \quad \text{[Formula 1]}$$

wherein Lper is the perception luminance, Lsti is the stimulation luminance, Lbg is the background luminance, α is a first constant, β is a second constant, and γ is a third constant.

2. The transparent display device of claim 1, wherein the stimulation luminance of the transparent display panel is calculated based on Formula 2:

$$Lsti=Lim+\{Lin\cdot T\} \quad \text{[Formula 2]}$$

wherein Lim is an image luminance, Lin is the luminance of the incident light, and T is the transmittance of the transparent display panel.

3. The transparent display device of claim 1, wherein the background luminance of the transparent display panel is calculated based on Formula 3:

$$Lbg=Lnim+\{Lin\cdot T\} \quad \text{[Formula 3]}$$

wherein Lnim is a non-image luminance, Lin is the luminance of the incident light, and T is the transmittance of the transparent display panel.

4. The transparent display device of claim 1, further comprising an incident light sensor which measures the luminance of the incident light to provide incident light information representing the luminance of the incident light to the luminance value compensator.

5. The transparent display device of claim 1, wherein the luminance value compensator is configured to receive transmittance information representing the transmittance of the transparent display panel from the transparent display panel.

6. The transparent display device of claim 1, wherein the gamma curve adjuster is configured to receive perception luminance information representing the perception luminance of the transparent display panel from the luminance value compensator.

7. The transparent display device of claim 6, wherein the gamma curve adjuster includes:

a gamma curve storing block which stores the reference gamma curve;

a gamma value calculating block which calculates an application gamma value based on the reference gamma value of the reference gamma curve and the perception luminance of the transparent display panel; and a gamma curve generating block which generates the application gamma curve having the application gamma value.

8. The transparent display device of claim 7, wherein the reference gamma value of the reference gamma curve is 2.2.

9. The transparent display device of claim 1, wherein, when the transmittance is equivalent to 35 percent (%), the luminance value compensator is configured to calculate the perception luminance of the transparent display panel based on Formula 4:

$$Lper=\{2.2\cdot Lsti+74.0\}\cdot\{1.5\cdot\log(Lst/Lbg)+1\} \quad \text{[Formula 4].}$$

10. The transparent display device of claim 1, wherein, when the transmittance is equivalent to 70%, the luminance value compensator is configured to calculate the perception luminance of the transparent display panel based on Formula 5:

$$Lper=\{1.4\cdot Lsti+88.3\}\cdot\{1.0\cdot\log(Lsti/Lbg)+1\} \quad \text{[Formula 5].}$$

11. A method of driving a transparent display device, the method comprising:

calculating, by a first processor, a perception luminance of a transparent display panel based on a luminance of incident light that is incident on the transparent display panel and a transmittance of the transparent display panel;

calculating, by a second processor, an application gamma value based on a reference gamma value of a reference gamma curve and the perception luminance of the transparent display panel;

generating an application gamma curve having the application gamma value; and converting image data into a data signal, which is to be applied to the transparent display panel, based on the application gamma curve, wherein the perception luminance of the transparent display panel is calculated based on Formula 6 representing a relation between the perception luminance of the transparent display panel, a stimulation luminance of the transparent display panel and a background luminance of the transparent display panel:

$$Lper=\{\alpha\cdot Lsti+\beta\}\cdot\{\gamma\cdot\log(Lsti/Lbg)+1\} \quad \text{[Formula 6]}$$

wherein Lper is the perception luminance, Lsti is the stimulation luminance, Lbg is the background luminance, $\alpha$ is a first constant, $\beta$ is a second constant, and $\gamma$ is a third constant.

12. The method of claim 11, wherein the stimulation luminance of the transparent display panel is calculated based on Formula 7:

$$Lsti=Lim+\{Lin\cdot T\} \quad \text{[Formula 7]}$$

wherein Lim is an image luminance, Lin is the luminance of the incident light, and T is the transmittance of the transparent display panel.

13. The method of claim 11, wherein the background luminance of the transparent display panel is calculated based on Formula 8:

$$Lbg=Lnim+\{Lin\cdot T\} \quad \text{[Formula 8]}$$

wherein Lnim is a non-image luminance, Lin is the luminance of the incident light, and T is the transmittance of the transparent display panel.

14. The method of claim 11, the method further comprising:

measuring, by a sensor, the luminance of the incident light to generate incident light information representing the luminance of the incident light.

15. The method of claim 11, the method further comprising:

receiving, by the first processor, transmittance information representing the transmittance of the transparent display panel from the transparent display panel.

16. The method of claim 11, wherein the reference gamma value of the reference gamma curve is 2.2.

17. The method of claim 11, wherein, when the transmittance is equivalent to 35%, the perception luminance of the transparent display panel is calculated based on Formula 9:

$$Lper=\{2.2\cdot Lsti+74.0\}\cdot\{1.5\cdot\log(Lsti/Lbg)+1\} \quad \text{[Formula 9].}$$

18. The method of claim 11, wherein, when the transmittance is equivalent to 70%, the perception luminance of the transparent display panel is calculated based on Formula 10:

$$Lper=\{1.4\cdot Lsti+88.3\}\cdot\{1.0\cdot\log(Lsti/Lbg)+1\} \quad \text{[Formula 10].}$$

* * * * *